US006266499B1

(12) United States Patent
Murata et al.

(10) Patent No.: US 6,266,499 B1
(45) Date of Patent: Jul. 24, 2001

(54) TRANSFER METHOD FOR ELECTROPHOTOGRAPHIC APPARATUS

(75) Inventors: Takahiko Murata; Masashi Fujishima; Masanobu Maeshima, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/575,453

(22) Filed: May 22, 2000

(30) Foreign Application Priority Data

Aug. 11, 1999 (JP) ..... 11-228002
Mar. 16, 2000 (JP) ..... 2000-074205

(51) Int. Cl.[7] ..... G03G 21/00
(52) U.S. Cl. ..... 399/98; 399/543
(58) Field of Search ..... 399/34, 98, 99, 399/101, 121, 123, 343, 353, 354, 388, 390; 15/102

(56) References Cited

U.S. PATENT DOCUMENTS 5,923,943 * 7/1999 Ahn .

FOREIGN PATENT DOCUMENTS 56-108641 * 8/1981 (JP) .
3-147648 * 6/1991 (JP) .
10-291670 * 11/1998 (JP) .

* cited by examiner

*Primary Examiner*—Arthur T. Grimley
*Assistant Examiner*—Hoan Tran

(57) ABSTRACT

In a transfer method of this invention, a paper powder-removing device having a pair of an insulating roller and an electrically conducting roller is provided on a transfer paper conveyer passage, and a transfer paper is passed through between a pair of the above rollers prior to being fed to a transfer zone (between a transfer roller and a photosensitive material drum). The transfer paper is passed through the pair of rollers in a state where the electrically conducting roller is maintained at a potential of a polarity same as, or opposite to, that of the transfer roller depending upon the position of the electrically conducting roller (position on a side of the transfer surface of the transfer paper or position on a side opposite to the transfer surface) in the paper powder-removing device, in order to reliably remove the paper powder from the transfer paper and to effectively prevent the adhesion of the paper powder on the surface of the photosensitive material drum.

6 Claims, 2 Drawing Sheets

TRANSFER METHOD FOR ELECTROPHOTOGRAPHIC APPARATUS

BACKGROUND OF THE INVENTION

1. Field of the Invention

The present invention relates to a transfer method using a transfer roller that can be applied to electrophotograhic apparatuses such as copiers, printers, facsimiles, etc.

2. Description of the Prior Art

In an electrophotographic apparatus as represented by a copier, the surface of a photosensitive material drum is electrically charged uniformly, an electrostatic latent image corresponding to the original image is formed by light-exposure on the surface of the photosensitive material drum, the electrostatic latent image is developed to form a toner image on the surface of the photosensitive material drum, the toner image is transferred from the surface of the photosensitive material drum onto a transfer paper, and the transferred toner image is fixed by the application of heat and pressure to form a copy image.

In such an electrophotographic apparatus, a corona charger (transfer charger) or a transfer roller is widely used as a means for transferring the toner image formed on the surface of the photosensitive material drum onto the transfer member (paper).

According to the method which uses the corona charger, the back surface of the transfer member is electrically charged by corona discharge to a polarity opposite to that of the toner image, and the toner image is transferred by this electric charge onto the surface of the transfer paper.

According to the method which uses the transfer roller, a voltage is applied to the roller so that the roller is maintained at a potential of a polarity opposite to that of the toner image, the transfer paper is passed in this state between the photosensitive material and the transfer roller, and the toner image is transferred onto the surface of the transfer paper by an electric field established between the transfer roller and the toner image.

According to the transfer method which uses the corona charger, however, the transfer paper is electrostatically adsorbed by the surface of the photosensitive material drum. In order to separate the transfer member on which the toner image is transferred from the surface of the photosensitive material drum, therefore, an AC charger must be employed causing the transfer mechanism to become complex. There further arouses a problem of generation of ozone due to corona charging.

According to the transfer method which uses the transfer roller, on the other hand, the transfer paper can be separated from the surface of the photosensitive material drum relatively easily without the need of using the corona charger such as AC charger as a separation mechanism and without generating ozone, giving advantage over the method that uses the corona charger.

When the toner image is to be transferred onto the transfer paper, however, paper powder (paper dust) generating from the transfer paper brings about a problem. That is, when the paper powder adheres on the surface of the photosensitive material drum, it has been known that the image becomes defective due to defective cleaning and a drop in the main charging potential on the surface of the photosensitive material drum. In particular, when the toner image is transferred by using the transfer roller, the paper powder is formed conspicuously.

Recently, furthermore, it is a tendency to employ a toner recycling method for recycling the residual toner recovered by the cleaning device into the developing device to reuse it. When this method is employed, however, the generation of paper dust becomes a problem.

It therefore becomes necessary to remove the paper powder from the transfer paper prior to transferring the toner image.

The most generally employed method of removing the paper powder consists of passing the transfer paper between a pair of insulating rollers to scratch the paper powder off the transfer paper by the rollers while imparting a frictional charge thereto.

According to the above method that uses the pair of insulating rollers, however, it is not allowed to remove the paper powder from the transfer paper to a sufficient degree, and an improvement has been desired. In particular, this tendency becomes conspicuous when the developing is effected by using a toner that is positively charged.

SUMMARY OF THE INVENTION

It is therefore an object of the present invention to provide a transfer method capable of effectively removing paper powder from the transfer paper in transferring a toner image from the surface of a photosensitive material drum onto the surface of the transfer paper by using a transfer roller.

Another object of the present invention is to provide a transfer method capable of effectively removing paper powder from the transfer paper even when the developing is conducted by using a toner that is positively charged.

According to the present invention, there is provided a transfer method of transferring a toner image formed by developing an electrostatic latent image on the surface of a photosensitive material drum onto the surface of a transfer paper from the surface of said photosensitive material drum, by arranging a transfer roller so as to be opposed to the surface of said photosensitive material drum, maintaining said transfer roller at a potential of a polarity opposite to the polarity of the electric charge of the toner, and passing the transfer paper in this state through a gap between said transfer roller and said photosensitive material drum; wherein a paper powder-removing device comprising a pair of an insulating roller and an electrically conducting roller is provided on a conveyer passage of said transfer paper, and said transfer paper, after having passed through the pair of said rollers, is passed through the gap between said transfer roller and said photosensitive material drum to effect the transfer of toner image;

when said electrically conducting roller is arranged on a side opposite to the transfer surface of the transfer paper that passes through the pair of said rollers, said transfer paper is passed in a state where said electrically conducting roller is maintained at a potential of the polarity same as that of said transfer roller; and when said electrically conducting roller is arranged on a side of the transfer surface of the transfer paper that passes through the pair of said rollers, said transfer paper is passed in a state where said electrically conducting roller is maintained at a potential of the polarity opposite to that of said transfer roller.

If briefly described, the transfer method of the present invention has an important feature in that a pair of an electrically conducting roller and an insulating roller are used as a paper powder-removing device that is disposed on the transfer paper conveyer passage prior to effecting the transfer of toner image, and the transfer paper is passed between the pair of said rollers in a state where the electrically conducting roller is maintained at a potential of a predetermined polarity, in order to remove the paper powder from the transfer surface of the transfer paper prior to effecting the transfer of toner image. The transfer surface means the surface on where the toner image is to be transferred upon coming in contact with the surface of the photosensitive material drum.

Paper powder generated in the step of producing the paper or generated by friction during the transport of the paper is contained in the transfer paper that is fed into a transfer zone between the photosensitive material drum and the transfer roller. The paper powder is, in many cases, electrically charged into a predetermined polarity due to friction. Therefore, the photosensitive material drum maintained at a high potential tends to be adhered with increased amounts of paper powder.

The present invention utilizes such a property of the paper powder, and uses a pair of an electrically conducting roller and an insulating roller as a paper powder-removing device, maintains the electrically conducting roller at a potential of a predetermined polarity, and forms an environmental condition close to the transfer condition as much as possible relying upon the pair of said rollers in order to reliably remove paper powder which easily adheres onto the photosensitive material drum.

According to the present invention, therefore, when the electrically conducting roller is arranged on the side opposite to the transfer surface of the transfer paper, the transfer paper is passed through between the pair of rollers in a state where the electrically conducting roller is maintained at a potential of the same polarity as the transfer roller, so that the paper powder is trapped by the insulating roller. In this case, the electrically conducting roller is disposed on the side of the transfer roller with respect to the transfer paper, and the insulating roller is disposed on the side of the photosensitive material drum.

When the electrically conducting roller is disposed on the side of the transfer surface of the transfer paper, the transfer paper is passed through the pair of rollers in a state where the electrically conducting roller is maintained at a potential of a polarity opposite to that of the transfer roller, so that the paper powder is trapped by the electrically conducting roller. In this case, the electrically conducting roller is disposed on the side of the photosensitive material drum with respect to the transfer paper, and the insulating roller is disposed on the side of the transfer roller.

The invention can be effectively applied to transferring the image in a system in which the developing is effected by using a positively charged toner or in a system in which the developing is effected based on the reversal development using a positively charged photosensitive material. That is, when the positively charged toner is to be transferred onto the transfer paper, the transfer roller is maintained at a potential of the negative polarity. The transfer paper is usually blended with a large amount of a filler such as talc or calcium carbonate which tends to be easily charged into the negative polarity. Accordingly, the paper powder tends to be negatively charged. In the system in which the developing is executed as described above, therefore, it is considered that the paper powder easily adheres onto the photosensitive material drum particularly during the transfer of image.

The present invention described above makes it possible to reliably remove the paper powder charged into a polarity (negative polarity) that tends to adhere onto the photosensitive material drum, and is particularly useful for a developing system in which the paper powder tends to easily adhere onto the photosensitive material drum.

DETAILED DESCRIPTION OF THE INVENTION

The invention will now be described in detail based on an embodiment shown in the accompanying drawings.

Figure 1:
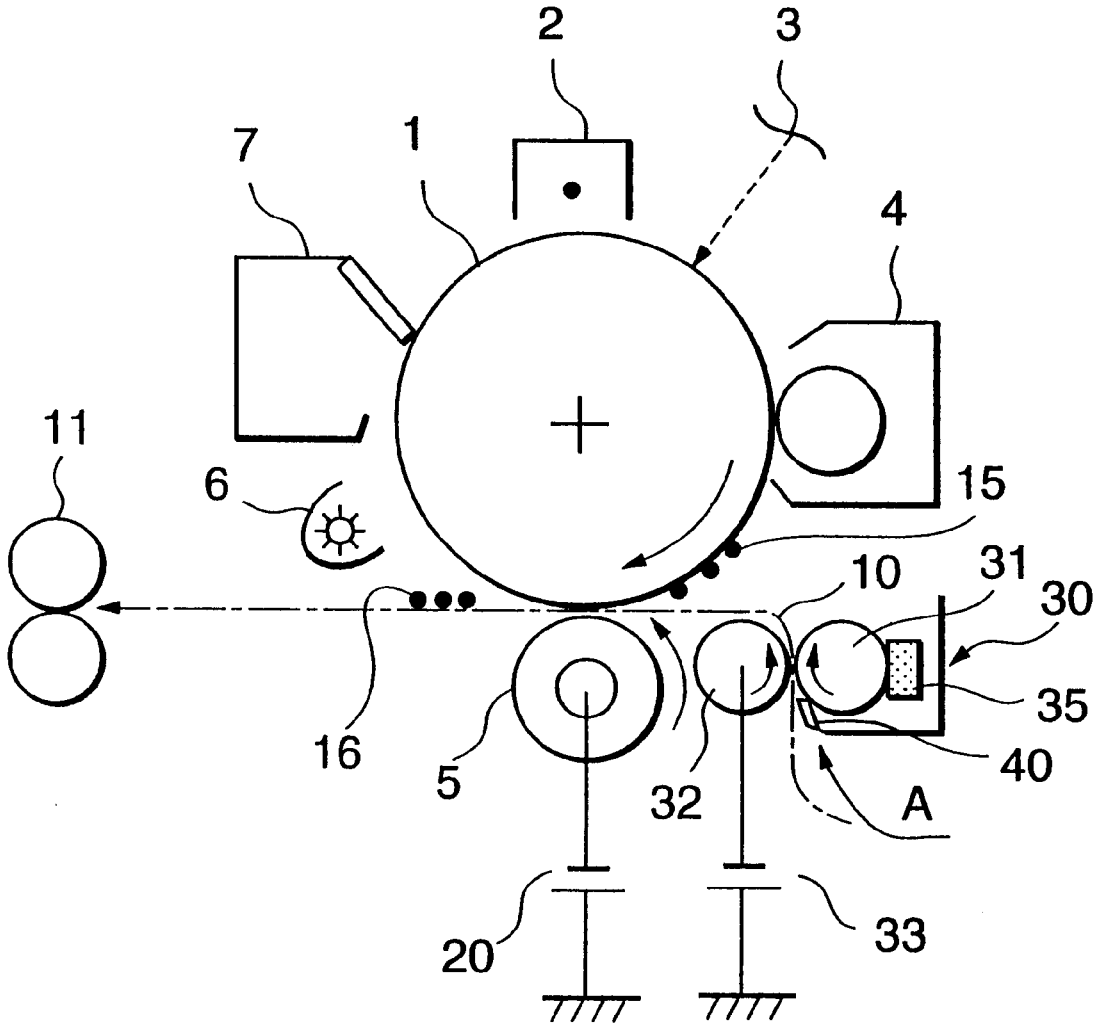
FIG. 1 is a view schematically illustrating the whole arrangement of an electrophotographic apparatus using the transfer method of the present invention.

In an electrophotographic apparatus shown in FIG. 1, a photosensitive material drum 1 which is allowed to rotate in a direction of an arrow in the drawing is surrounded by a main charging device 2, an exposure mechanism 3, a developing device 4, a transfer roller 5, a charge-removing device 6 and a cleaning device 7 in order mentioned along the direction in which the photosensitive material drum 1 rotates. A transfer paper 10 passes through between the photosensitive material drum 1 and the transfer roller 5, and a fixing device 11 is provided on a passage through which the transfer paper 10 is discharged.

As the photosensitive material drum 1, there can be used an inorganic photosensitive material drum comprising a photosensitive layer such as of selenium or amorphous silicon formed on an electrically conducting base roller such as of aluminum, or an organic photosensitive material drum provided with an organic photosensitive layer obtained by dispersing a charge-generating agent and a charge-transporting agent in a binder resin.

As the main charging device 2, where has been used a roller-type contact charging device. Generally, however, a corona charger is used. Due to the main charging device 2, the surface (photosensitive layer) of the photosensitive material drum 1 is uniformly charged to a predetermined polarity depending upon the kind of the photosensitive layer. In this case, the main charging potential on the surface of the photosensitive material is usually from 200 to 1000 V (absolute value).

Next, due to the image exposure mechanism 3, the surface of the photosensitive material drum is irradiated with light reflected by the original or a dot beam such as laser beam corresponding to the original in accordance with electric signals from a computer, whereby the potential in the portion irradiated light attenuates to form an electrostatic latent image.

In the developing device 4, a developing agent conveyer sleeve is arranged so as to be opposed to the photosensitive material drum 1. Due to the developing sleeve, the developing agent is supplied to the developing zone between the photosensitive material drum 1 and the sleeve, thereby to develop the electrostatic latent image. As the developing agent, there is usually used a two-component developing agent comprising a magnetic carrier and an insulating toner, or a one-component developing agent comprising a magnetic toner. The toner electrically charged by friction is conveyed in the form of a magnetic brush adjusted to a predetermined ear length, and the electrostatic latent image is developed by the toner thereby to form a toner image 15 on the surface of the photosensitive material drum 1. The polarity of charge of the toner, i.e., of the toner image 15 is opposite to the polarity of charge on the surface of the photosensitive material drum 1 when the image is formed by the so-called normal developing, and is the same as the polarity of charge on the surface of the photosensitive material drum 1 when the image is formed by the reversal development.

The transfer roller 5 is constituted by a rubber, a resin, or a foamed product thereof to which electric conductivity is imparted upon being mixed with an electrically conducting powder such as metal powder or carbon powder or with ions, and is applied with a transfer voltage from a DC power source 20 so as to be maintained, generally, at a transfer potential of from about 100 to about 4000 V (absolute value), so that a current of from 2 to 40 $\mu$A flows into the transfer roller during the transfer of image. In this state, the toner image 15 is transferred onto the transfer paper 10 passing through between the transfer roller 5 and the photosensitive material drum 1, thereby to form a transferred toner image 16. In FIG. 1, the power source 20 has such a polarity that the transfer roller 5 is maintained at a potential of negative polarity. When the developing is to be effected by using a negatively charged toner, however, the polarity of the power source 20 is reversed so that the transfer roller 5 is maintained at a potential of positive polarity.

The transfer roller 5 is so arranged as to follow the turn of the photosensitive material drum 1. Here, it is desired that the gap between the surface of the transfer roller 5 and the surface of the photosensitive material drum 1 is not larger than 0.5 mm and, particularly, from 0.1 to 0.5 mm. When the gap is larger than 0.5 mm, it becomes difficult to effectively accomplish the transfer of image.

The transfer paper 10 having the transferred toner image 16 is conveyed to the fixing device 11 where the transferred toner image 16 is fixed on the surface of the transfer paper 10 by heat and pressure.

On the other hand, after the toner image 15 is transferred onto the transfer paper 10, the electric charge is removed from the surface of the photosensitive material drum 1 due irradiation with light by the charge-removing device 6. As required, further, the toner remaining on the surface of the photosensitive material drum 1 is scratched off and is recovered by the cleaning device 7 having a cleaning blade and, then, the next image-forming process is executed. As required, the toner recovered by the cleaning device 7 is recycled into the developing device 4 and is reused.

In the present invention, a paper powder-removing device 30 is disposed on the passage for conveying the transfer paper 10 indicated by an arrow A in FIG. 1. The device 30 is constituted by a pair of an insulating roller 31 and an electrically conducting roller 32. These rollers so rotate as to feed the transfer paper 10 passing through between the two rollers toward the side of the transfer roller 5. The gap between the insulating roller 31 and the electrically conducting roller 32 has been so set that the transfer paper 10 comes in contact with both rollers as it passes through therebetween.

In the example shown in FIG. 1, the insulating roller 31 is disposed on the side of the transfer surface of the transfer paper 10, the electrically conducting roller 32 is disposed on the side of the back surface of the transfer paper 10 (on the side opposite to the transfer surface), and the power source 33 is connected to the electrically conducting roller 32 so as to maintain at a potential of the same polarity as that of the transfer roller 5.

Onto the surface of the insulating roller 31 is press-contacted a scratching member 35 for removing the paper powder scratched off the transfer paper 10. It is desired that the scratching member 35 is usually formed of an insulating member having a cushioning property, such as sponge, felt or brush. Such a scratching member 35 may also be provided on the surface of the electrically conducting roller 32, as a matter of course.

In the example of FIG. 1, the transfer paper 10 is passed between the insulating roller 31 and the electrically conducting roller 32, so that the paper powder on the transfer surface of the transfer paper 10 is scratched off by the insulating roller 31 and is trapped by the scratching member 35. In this case, the electrically conducting roller 32 positioned on the side of the transfer roller 5 with respect to the transfer paper 10 is maintained at a potential of the polarity same as that of the transfer roller 5. Therefore, the paper powder electrically charged into a polarity that migrates toward the photosensitive material drum 1 due to the electric field established between the transfer roller 5 and the photosensitive material drum 1, is reliably scratched off and is removed by the insulating roller 31 due to electric repulsive force from the electrically conducting roller 32.

Figure 2:
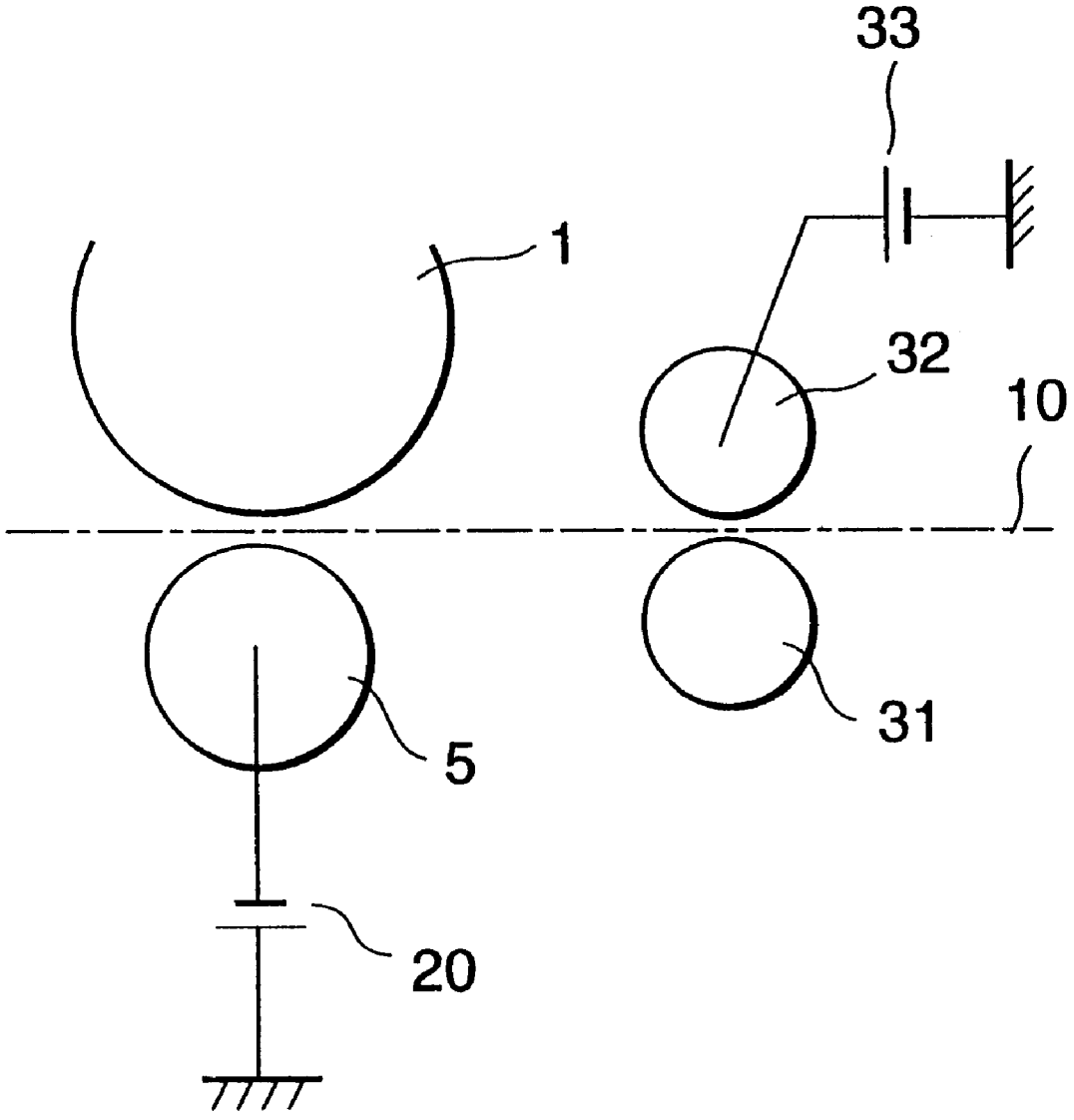
FIG. 2 is a view of when an electrically conducting roller in a paper powder-removing device used for carrying out the transfer method of the invention, is disposed at a position different from the position shown in FIG. 1.

In the example of FIG. 1, the electrically conducting roller 32 is disposed on the side opposite to the transfer surface of the transfer paper 10. As shown in FIG. 2, however, the electrically conducting roller 32 may be disposed on the side of the transfer surface of the transfer paper 10, and the insulating roller 31 may be disposed on the side opposite to the transfer surface. That is, in this case, the scratching member 35 is provided at least on the surface of the electrically conducting roller 32, and the paper powder on the transfer surface is removed by the electrically conducting roller 32.

In the example of FIG. 2, the electrically conducting roller 32 is maintained at a potential of a polarity opposite to that of the transfer roller 5 due to the power source 33. Therefore, the paper powder electrically charged into a polarity that migrates toward the photosensitive material drum 1 in the transfer zone is reliably trapped by the electrically conducting roller 32 due to the electric attractive force from the electrically conducting roller 32.

In the examples of FIGS. 1 and 2, therefore, it is desired that the voltage applied to the electrically conducting roller 32 from the power source 33 or, in other words, the potential of the electrically conducting roller 32 is, generally, from 100 to 5000 V (absolute value) though it may vary depending upon the potential of the transfer roller 5, and it is most desired that within this range the potential is closest to the potential of the transfer roller 5. When the electrically conducting roller 32 is maintained at a potential higher than the above range, no particularly distinguished advantage is obtained but simply the consumption of electric power increases. When the electrically conducting roller 32 is maintained at a potential lower than the above range, it becomes difficult to effectively remove the paper powder that is electrically charged to a polarity that tends to migrate toward the photosensitive material drum 1, and the paper powder may adhere on the surface of the photosensitive material drum 1.

In the present invention, the electrically conducting roller 32 may be formed of a good electric conductor such as copper, silver or aluminum, or may be made of a rubber, a resin, or a foamed product thereof to which the electrically conducting property is imparted by being mixed with an electrically conducting powder (such as metal powder or carbon powder) or ions like the above-mentioned transfer roller 5.

The insulating roller 31 may have an insulating surface; e.g., the surface of the metal roller may be covered with an insulating resin or elastomer.

In the present invention, further, it is desired to remove the paper powder by providing an insulating guide plate 40 near the pair of said rollers and introducing the transfer paper 10 into between the insulating roller 31 and the electrically conducting roller 32 in a manner that the transfer surface thereof comes in contact with the guide plate 40. That is, by so providing the guide plate 40, the paper powder positively generates on the transfer surface of the transfer paper 10 due to the frictional contact with the guide plate 40, and the paper powder is scratched off by the roller on the side of the transfer surface (insulating roller 31 in the example of FIG. 1 or the electrically conducting roller 32 in the example of FIG. 2). It is therefore allowed to effectively suppress the paper powder from being newly generated in the step of transfer.

The insulating guide plate 41 can be formed by using various electrically insulating resins, such as an ABS (acrylic nitrile-butadiene-styrene) resin or the like resin.

The transfer paper 10 from which the paper powder is removed by using the above-mentioned paper powder-removing device, is passed through between the transfer roller 5 and the photosensitive material drum 1 to effect the transfer of image. In transferring the image, therefore, the paper powder is effectively prevented from adhering onto the surface of the photosensitive material drum 1, and the image can be stably formed over extended periods of time.

According to the present invention, in particular, the paper powder is effectively prevented from adhering on the surface of the photosensitive material drum 1 even when the transfer method of the invention is applied to a developing system which uses a positively charged toner or to a reversal developing system which uses a positively charged photosensitive material.

EXAMPLES

(Example 1)

A modified machine was fabricated by modifying a digital printer, Antico 70, manufactured by Mita Kogyo Co., by disposing a paper powder-removing device constituted by a pair of an insulating roller and an electrically conducting roller on a transfer paper conveyer passage in a manner as shown in FIG. 1, and by removing the cleaning device. Images were formed by using this modified machine.

The specifications of the modified machine and the developing conditions were as follows:

| | |
|---|---|
| Photosensitive material drum: | positively charged organic photosensitive material drum having a diameter of 30 mm, |
| Main charge potential: | +800 V |
| Developing device: | two-component magnetic developing agent (positively charged toner, 4% by weight), distance between sleeve and drum, 0.8 mm, ear length of magnetic brush, 0.8 mm, developing system: reversal developing, developing bias: +600 V, |

-continued

| | |
|---|---|
| Transfer roller: | ionically conducting foamed urethane roller having a diameter of 16 mm, distance between roller and drum, 0.3 mm, roller potential: −1200 V (current flowing into the roller, −12 $\mu$A), |
| Paper powder-removing device: | conducting roller having a diameter of 20 mm (conducting rubber roller), potential of conducting roller, −1200 V, insulating roller having a diameter of 10 mm, polyacetal resin roller, insulating guide plate, ABS resin |
| Transfer paper: | 160 $mm^2$-thick A4-size common paper |

Images were formed consecutively on 50,000 pieces of transfer papers under the above-mentioned conditions, and the surface of the photosensitive material drum was observed. Adhesion of the paper powder was not at all recognized.

For the purpose of comparison, the paper powder-removing device was replaced by the one comprising a pair of insulating rollers, and the images were similarly formed. It was confirmed that the paper powder had been adhered in considerable amounts on the surface of the photosensitive material drum.

(Example 2)

Positions of the electrically conducting roller and of the insulating roller in the paper powder-removing device were changed as shown in FIG. 2, the potential of the electrically conducting roller was set to be +1200 V, and the images were form in the same manner as in Example 1. Adhesion of the paper powder on the surface of the photosensitive material drum was not at all recognized.

According to the transfer method of the present invention, use is made of the paper powder-removing device comprising the combination of an electrically conducting roller and an insulating roller, and the paper powder is removed by maintaining the electrically conducting roller at a potential of a polarity same as, or opposite to, that of the transfer roller depending upon the position of the electrically conducting roller, in order to effectively prevent the adhesion of paper powder on the surface of the photosensitive material drum.

The present invention can be particularly effectively applied to the electrophotographic apparatus which is based on a toner recycling method or a cleanerless method.

What is claimed is:

1. A transfer method of transferring a toner image formed by developing an electrostatic latent image on a surface of a photosensitive material drum onto a surface of a transfer paper from the surface of said photosensitive material drum, by arranging a transfer roller so as to be opposed to the surface of said photosensitive material drum, maintaining said transfer roller at a potential of a polarity opposite to the polarity of the electric charge of the toner image, and passing the transfer paper in this state through a gap between said transfer roller and said photosensitive material drum; wherein a paper powder-removing device comprising a pair of an insulating roller and an electrically conducting roller is provided on a conveyer passage of said transfer paper, and said transfer paper, after having passed through the pair of said rollers, is passed through the gap between said transfer roller and said photosensitive material drum to effect the transfer of toner image;

when said electrically conducting roller is arranged on a side opposite to the transfer surface of the transfer paper that passes through the pair of said rollers, said transfer paper is passed in a state where said electrically conducting roller is maintained at a potential of the polarity same as that of said transfer roller; and when said electrically conducting roller is arranged on a side of the transfer surface of the transfer paper that passes through the pair of said rollers, said transfer paper is passed in a state where said electrically conducting roller is maintained at a potential of the polarity opposite to that of said transfer roller.

2. A transfer method according to claim 1, wherein said electrically conducting roller is disposed at a position on a side opposite to the transfer surface of the transfer paper, and the paper powder is trapped by said insulating roller disposed on the side of said transfer surface.

3. A transfer method according to claim 1, wherein said electrically conducting roller is disposed on a side of the transfer surface of the transfer paper, and the paper powder is trapped by said electrically conducting roller.

4. A transfer method according to claim 1, wherein the transfer paper is passed between the pair of said rollers in a state where said electrically conducting roller is maintained at a potential of from 100 to 5000 V (absolute value).

5. A transfer method according to claim 1, wherein the electrostatic latent image formed on the surface of said photosensitive material drum is developed by using a positively charged toner, and the toner image is transferred in a state where said transfer roller is maintained at a potential of the negative polarity.

6. A transfer method according to claim 1, wherein an insulating guide plate is provided near said pair of rollers, and said transfer paper is introduced into between said pair of rollers in a manner to come into contact with said guide plate.

* * * * *